US006431975B1

(12) United States Patent
Ryan

(10) Patent No.: US 6,431,975 B1
(45) Date of Patent: Aug. 13, 2002

(54) FUME HOOD FOR LARGE CONTAINERS

(75) Inventor: Raymond F. Ryan, Wilmington, NC (US)

(73) Assignee: Flow Sciences, Inc., Wilmington, NC (US)

( * ) Notice: Subject to any disclaimer, the term of this patent is extended or adjusted under 35 U.S.C. 154(b) by 0 days.

(21) Appl. No.: 09/836,066

(22) Filed: Apr. 17, 2001

(51) Int. Cl.[7] ..... B08B 15/02
(52) U.S. Cl. ..... 454/49; 141/93; 454/56
(58) Field of Search ..... 454/49, 56; 141/93, 141/97

(56) References Cited

U.S. PATENT DOCUMENTS 3,121,618 A * 2/1964 Yerzley
4,276,819 A * 7/1981 Goldman et al.
4,566,293 A 1/1986 Amer et al.
4,630,654 A * 12/1986 Kennedy, Jr.
5,052,451 A * 10/1991 Gentilcore et al.
5,257,957 A 11/1993 Diccianni et al.
5,262,578 A 11/1993 Hall
5,322,095 A 6/1994 Bolz
5,755,181 A * 5/1998 Petkovski
5,890,781 A 4/1999 Ryder

* cited by examiner

*Primary Examiner*—Harold Joyce
(74) *Attorney, Agent, or Firm*—MacCord Mason PLLC

(57) ABSTRACT

A fume hood is described for use in removing material from, or inserting material into, the opening of a container. The fume hood enclosure has a floor with an opening for insertion of the upper end of the container into the enclosure, with a flexible member around the periphery of the opening to form a seal between the container and the enclosure when the upper end of the container is inserted into the enclosure. A base is provided supporting the hood at a level permitting insertion of the containers beneath the opening in the floor. A vertically adjustable carrier is provided to raise the container to insert the upper end of the container into the enclosure through the opening.

17 Claims, 4 Drawing Sheets

FUME HOOD FOR LARGE CONTAINERS

BACKGROUND OF THE INVENTION (1). Field of the Invention

The present invention relates to improved fume hoods or ventilated workstations, and in particular to fume hoods having a floor opening through which the upper end of a container is inserted into the hood enclosure.

(2). Description of the Prior Art

Fume hoods or vented workstations are used in laboratories and other environments to manipulate materials that might generate noxious or dangerous gases or fumes without releasing the materials or components or fumes therefrom into the work environment. Generally, these workstations are comprised of an enclosure or chamber in which materials are handled, and means for drawing air through a front opening in the enclosure. The operator also uses this front opening as the means of access into the enclosure. The enclosure also includes an exhaust opening, frequently communicating with a filter, to remove contaminants from air exhausted from the chamber.

The fume hood is normally comprised of side and top walls, which may be of transparent material, such as Plexiglas™ or other clear plastic, a rear wall with an exhaust opening, and a planar bottom wall or floor. The front edges of the top, side and bottom walls may form an operator access opening. A slidable or hinged door may be positioned to cover, or vary the size of, the access opening. Generally, the hood is configured, and air vanes are often added, so that air enters the access door and is exhausted through the exhaust opening, with generally laminar airflow being maintained within the chamber to avoid air turbulence that could disturb the materials being manipulated.

Escape of contaminated air from the hood chamber through the access opening into the work environment is prevented by maintaining a pressure differential between the chamber, or hood interior, and the work environment, or hood exterior, so that air continually flows from the hood exterior through the access opening into the hood interior. A sufficient air velocity at the access opening, known as the "face velocity," must be maintained to prevent contaminated air from escaping.

Contaminated air is exhausted from a fume hood through an exhaust conduit that includes a vacuum source to draw the air through the exhaust conduit. Generally, this vacuum source is comprised of an exhaust fan positioned within the conduit, and an electric motor to turn the fan. The gas may be exhausted to the exterior environment when toxic contaminants are not present. In many instances, however, the air will be conveyed through a filter, such as a HEPA filter, to remove contaminants from the air.

When working with hazardous or toxic material, there is frequently a need to remove materials from a container, to insert materials into a container, or to transfer material from one container to another container. Some of these containers, which may be carboys, drums, or the like, are quite large and difficult to maneuver. Therefore, placement of one or more of these containers into a fume hood to prevent escape of hazardous materials into the surrounding environment, as well as their subsequent removal, and the insertion or transfer of materials to or from these containers, can be difficult, if not impossible.

Thus, a need exists for an apparatus to facilitate the addition, removal or transfer of hazardous materials to or from large containers within a controlled environment, so that the materials will not be inadvertently discharged into the work environment.

SUMMARY OF THE INVENTION

The present invention addresses this need by providing a fume hood that is uniquely configured to receive the access-opening upper portion of a large container within the hood enclosure, thereby providing access from within the hood enclosure to the container's contents. Basically, the fume hood is comprised of an enclosure having walls that define a chamber that includes at least one container-receiving opening in the floor of the enclosure. The enclosure is supported so that a large container having a top opening through which material can be added to, or removed from, can be positioned beneath the enclosure and then raised upwardly, so that the upper section of the container projects through the opening and into the enclosure.

The operator can then open the container from within the enclosure, remove or add material, and then close the container. The container is then lowered to separate the container from the enclosure. As a result, the opening into the container is at all times within the fume hood enclosure when the container is open, thereby preventing hazardous materials from escaping from outside the hood enclosure. As used herein, the term "hazardous" is broadly intended to include all materials, whether in powder, liquid or gaseous form, where escape beyond a confined area is undesirable, and the term "container" is intended to include all containers for such materials.

The fume hood is generally comprised of the enclosure and a plenum at the rear of the enclosure to receive contaminated air from the enclosure. When used, an exhaust conduit will be connected to the plenum to convey contaminated air to a remote location, which may include a filtration means. A base or support is used to position the enclosure at a level permitting insertion of a hazardous materials container beneath the enclosure.

Generally, the enclosure includes a pair of spaced, parallel side walls; rear and upper walls joining the side walls; and the aforementioned bottom wall or floor, that together define the work chamber of the enclosure. The front edges of the side, upper and bottom walls together define an access opening or inlet into the chamber through which the operator can manipulate material within the chamber. Air also enters the chamber through this access opening.

The enclosure may also include a moveable closure or door to vary the size of the access opening. An air exhaust opening leading to an exhaust plenum is preferably located on the opposite side of the chamber from the access opening, so that air flows across the chamber from the access opening to the discharge opening. The sidewalls, front and/or upper walls of the enclosure are preferably of a clear, impact resistant plastic to facilitate viewing of the chamber contents.

The bottom wall or floor of the enclosure is preferably comprised of a planar work surface with rear and side edges joining the rear and side walls, respectively, of the enclosure. At least one container-receiving opening extends through the floor. Preferably, the opening is large enough to accommodate the largest container to be used, and is of a shape corresponding to the cross-section of the container. That is, a round hole will preferably be used for cylindrical containers, such as drums or carboys, while a rectangular hole will be used for rectangular containers, such as boxes.

In order to accommodate containers of different sizes, and to ensure that an airtight seal is formed around the container when the upper section of the container is inserted through the opening, detachable rings or frames may be secured around the periphery of the opening, to change the size of the opening.

Each ring or frame also includes an attached, inwardly extending, flexible ring or member that forms a flexible seal between the container and the floor when the container is inserted through the flexible member. It will be understood, of course, that the flexible member may be attached directly to the floor, if the enclosure is to be used to manipulate the contents of only one size container.

Depending upon the desired use, the enclosure floor can include one opening, or two or more openings. Thus, when the need is to remove material from a single container, so that the material can be placed within a smaller container inside the enclosure, or otherwise used, only one opening will be required. Similarly, one opening is all that is needed if material is to be removed from smaller containers in the enclosure and inserted into a larger container that extends into the enclosure. In both instances, the enclosure will preferably include floor space to accommodate the smaller containers or other objects within the chamber.

However, if material is to be transferred from one large container to another large container, the floor will require two openings, one for each container. Depending upon the containers, these openings can be of the same or different cross-sectional shapes. Also, the floor openings may be of the same size, with rings or frames of different sizes being attached over the floor openings to conform to containers of different sizes.

Air is exhausted from the enclosure interior through one or more exhaust openings in the enclosure rear wall and through a plenum that is in communication with the rear wall openings. The plenum includes an interior chamber, preferably formed of a pair of spaced side walls extending rearwardly from the rear enclosure wall, a back wall spaced from the rear wall, a bottom wall extending upwardly at an angle from the rear wall to the back wall, and a top wall. Instead of one plenum, two plenums of similar construction can be used, with the plenums being placed side-by-side on the back surface of the enclosure rear wall.

The exhaust openings leading to each plenum are preferably in the form of a pair of spaced horizontal slots extending across the rear of the chamber. To optimize laminar flow, the lower slot is approximately twice the size of the upper slot, and is located adjacent the lower edge of the plenum, while the smaller upper slot is located adjacent the top of the plenum.

An exhaust conduit attachment opening is normally located in the plenum back or top wall to join the plenum to an exhaust conduit. The exhaust conduit is in communication with an exhaust fan, such as an in-line duct fan, or other vacuum source, to draw air from the enclosure chamber, and through the conduit. The air exiting the conduit is then exhausted to the atmosphere after filtration as required. Preferably, contaminants are first removed from the air by conveying the air through a filter medium, ideally a HEPA filter, contained within a housing that also includes a collection chamber. The volume of air conveyed through the exhaust conduit is controlled by an in-line valve or damper that is rotated to any position between closed and fully open positions by a control means, such as a stepping motor.

The enclosure is supported so that the lower surface of the enclosure floor is supported above the floor or other surface at a height at least equal to the height of the container to be emptied, so that the container can be positioned beneath the enclosure before being raised into the opening. Since some containers may be quite heavy, and since the container must be held in the raised position during addition or removal of material, the container is preferably supported on a vertically adjustable platform, such as a wheeled carrier that can be rolled into position beneath the enclosure. If so, the enclosure will be supported at a height sufficient to permit insertion of the platform and a container carried on the platform when the platform is in the lowered position. Thus, the overall system will be comprised of the fume hood, a hood base or support, and the vertically adjustable container carrier.

The fume hood may include other features to increase its utility. For example, a waste disposal opening may be incorporated into the floor or wall of the enclosure, so that waste created during manipulation of materials in the enclosure can be disposed of without discharging hazardous material into the environment. This opening can be in the form of an outwardly projecting chute or port that can be attached in an airtight manner to a bag or other receptacle. For instance, annular flexible rings may be used to hold sealing bags away from a container during removal or insertion of hazardous material. These rings, which may become contaminated with hazardous material, can be disposed of through the disposal opening after use.

In operation, a hazardous material container having a top opening is moved beneath the enclosure, e.g., by placing the container on a vertically adjustable platform of a wheeled carrier and rolling the container beneath the enclosure. The container is then raised so that the upper section of the container extends through a floor opening to position the container opening within the chamber, with the flexible member snugly forming an airtight seal between the floor and the container wall.

The operator then reaches inside the enclosure to remove the cover from the container, providing access to its contents. After removal of the desired contents, the operator reseals the container and lowers it from the enclosure. Since air is conveyed from the front of the enclosure through the exhaust conduit, no hazardous material is allowed to escape from the enclosure. A similar procedure is employed when hazardous material is to be placed onto the container or when material is to be transferred between containers.

DETAILED DESCRIPTION OF THE PREFERRED EMBODIMENTS

Figure 1:
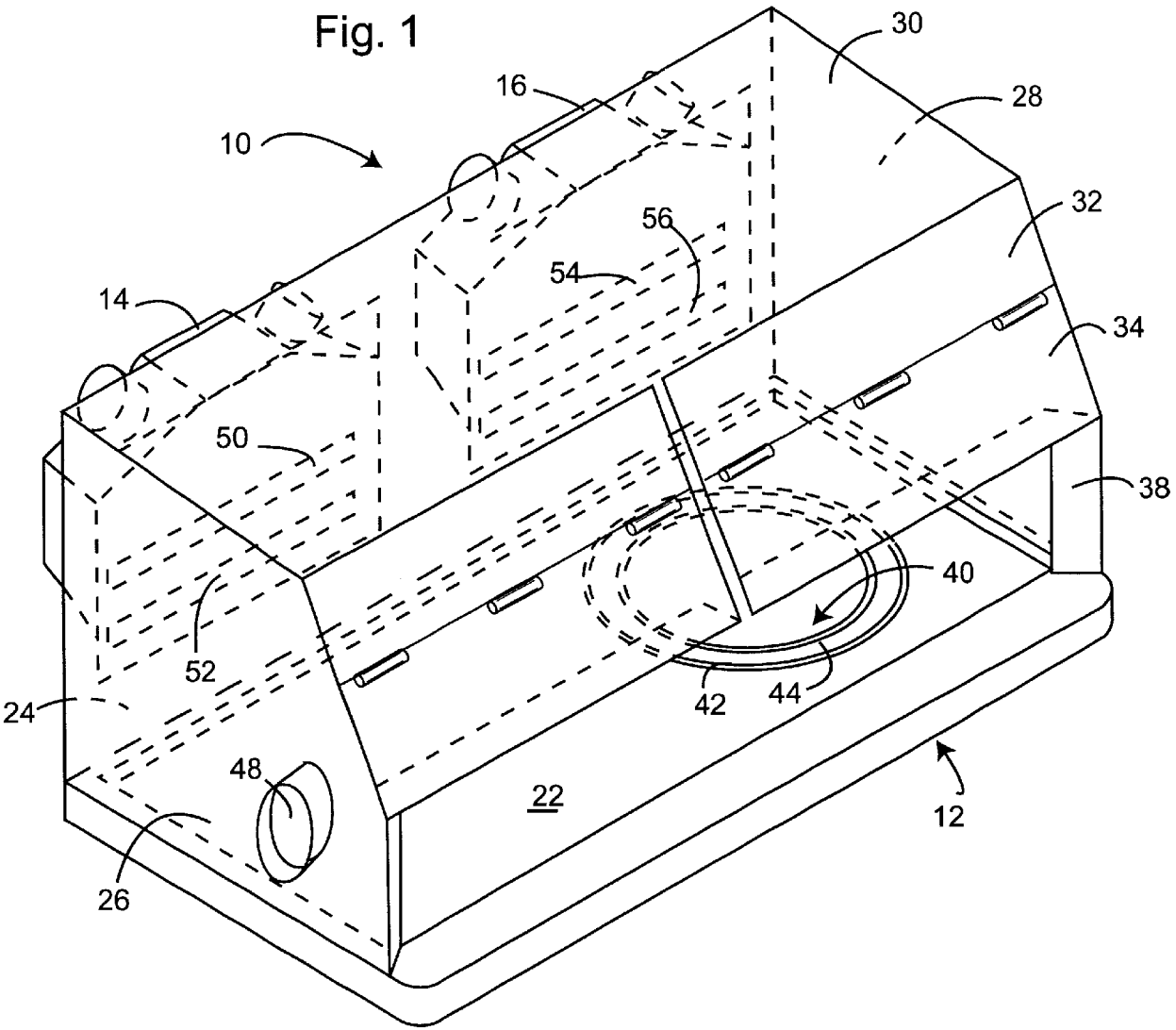
FIG. 1 is a perspective view of a fume hood of the present invention with one floor opening.

As shown in the drawings, which are for purposes of illustration and are not to scale, the fume hood, generally 10, of the invention is comprised of an enclosure, generally 12, with attached plenums 14 and 16, that are in communication with the interior of enclosure 12. The overall system of the invention further includes a hood support 18 to position the hood at a desired level above floor "F", and a container carrier 20, to position a container "C" beneath enclosure 12.

Enclosure 12 is comprised of a floor 22, a rear wall 24, side walls 26 and 28, a top wall 30, and a front wall formed of upper section 32 and hinged lower section 34. The front edges of lower front wall section 34 and side walls 26 and 28, together with floor 22 form a front access opening for use by an operator in manipulating materials and objects within enclosure 12, and for entry of air. As shown in the drawings, the front wall is formed of left and right sections. Vanes 38 extend inwardly at an angle from the front edges of section 34 and sidewalls 26 and 28 to promote laminar flow.

Figure 2:
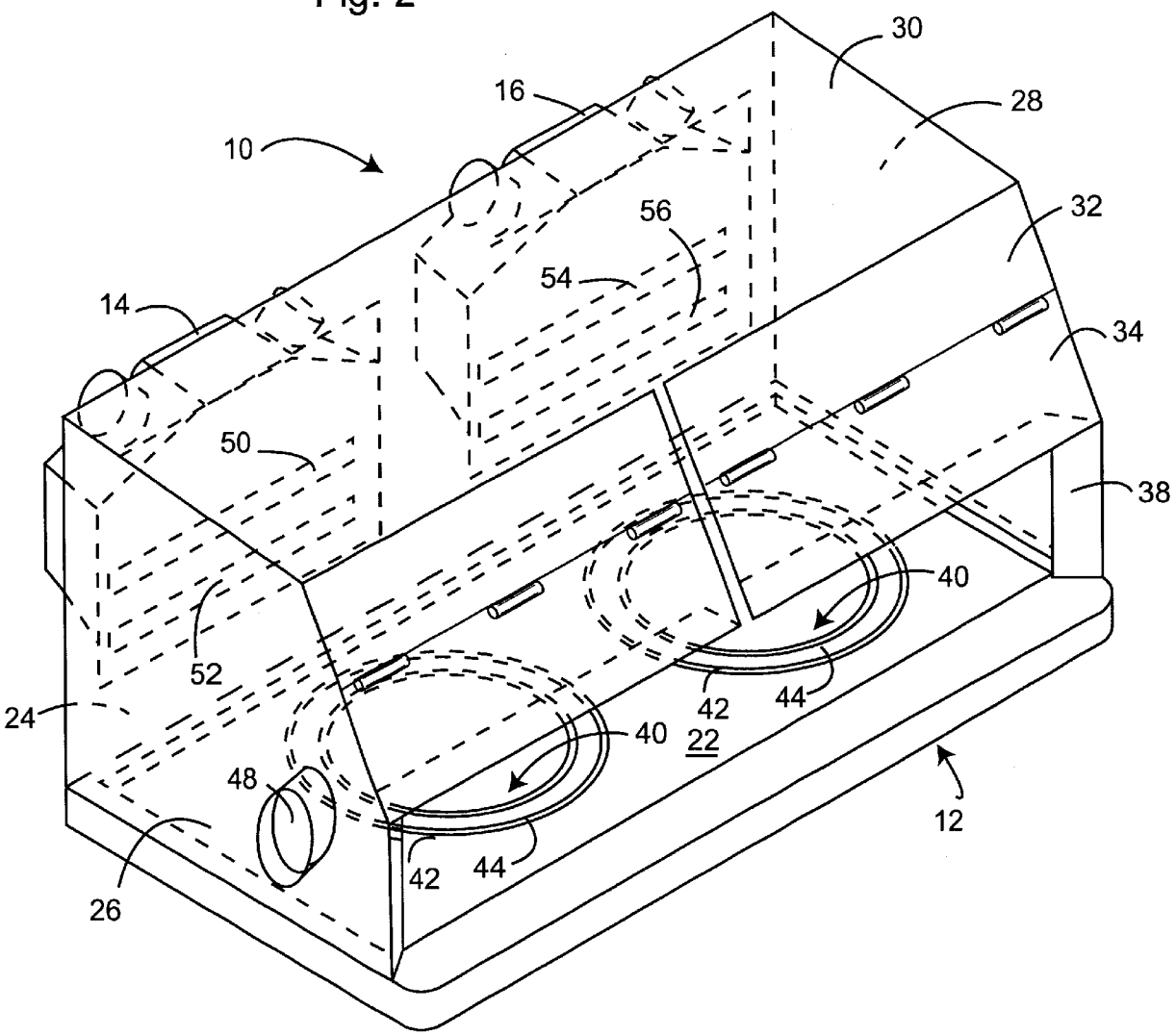
FIG. 2 is a perspective view of a fume hood of the present invention with two floor openings.
Figure 3:
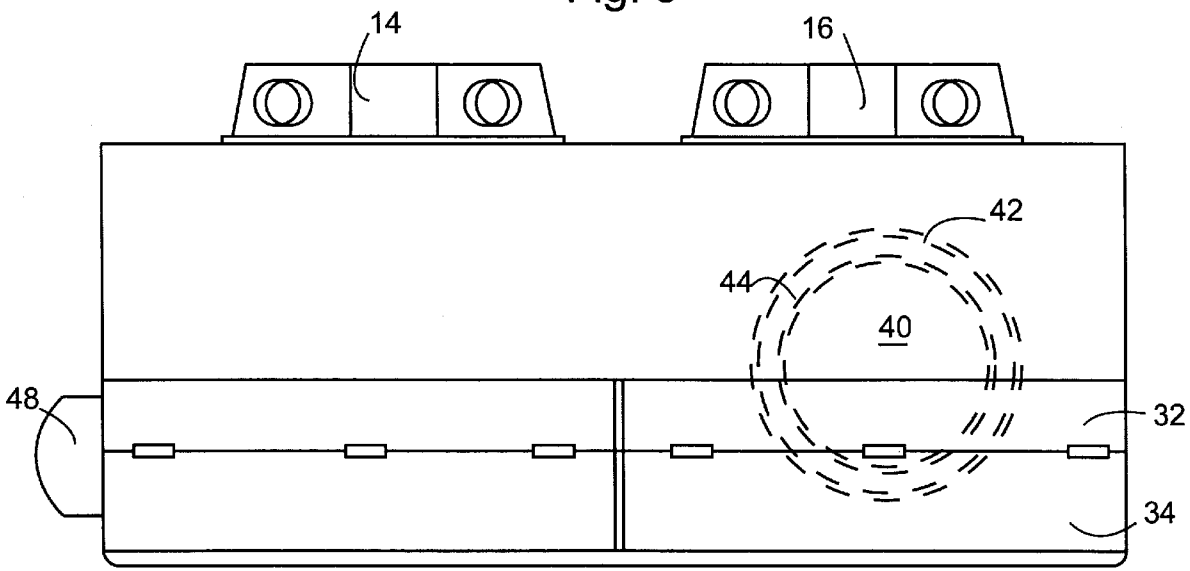
FIG. 3 is a top view of the hood of FIG. 1.
Figure 4:
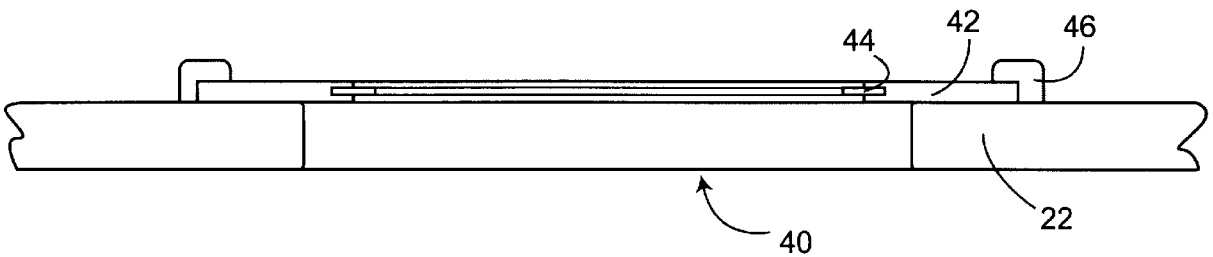
FIG. 4 is a detailed side view of a ring and flexible membrane mounted beneath a floor opening.
Figure 5:
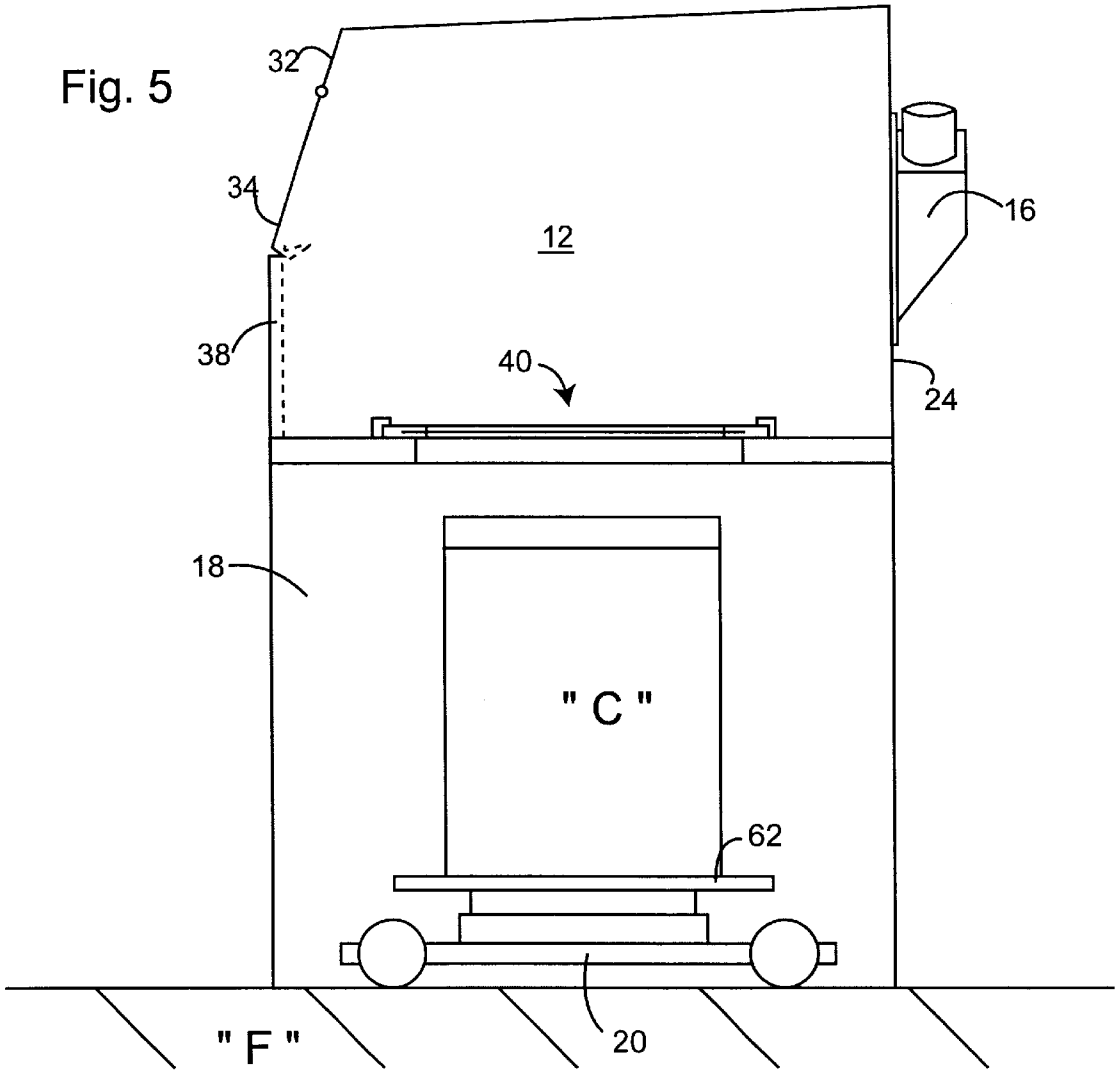
FIG. 5 is a sectional side view of the fume hood of FIG. 1 mounted on a support, with a container on a container carrier beneath the floor opening of the fume hood.

Floor 22 has raised edges so that spills will be captured within enclosure 12. Floor 22 includes an opening 40, shown as a circular opening in the preferred embodiment. A detachable ring 42 is fitted around the periphery of opening 40 to support an annular flexible membrane 44 that has an inner diameter slightly less than the outer diameter of container "C". Retainers 46 are used to hold ring 42 in contact with floor 22. As illustrated in FIG. 2, floor 22 may include two floor openings 40 with rings 42 and flexible membranes 44.

Sidewall 26 includes discharge port 48, which can be used to dispose of items contaminated within enclosure 12. Port 48 is attachable to a bag, not shown, that can be attached around port 48 with an airtight seal.

Plenums 14 and 16, which are of the same construction, are mounted on rear wall 24. Air is drawn from enclosure 12 into plenum 14 through slots 50 and 52, and from enclosure 12 into plenum 16 through slots 54 and 56. Exhaust conduits, not shown, draw contaminated air from plenums 14 and 16 for filtration. Hood 10 is supported on a base or support 18 so that container "C" can be raised through opening 40. A wheeled container cart or carrier, generally 20 that includes a vertically adjustable platform 62 is used to move container "C" beneath hood 10.

In operation, container "C" is rolled on carrier 20 beneath opening 40. Platform 62 is then moved from its lowered position to its raised position to insert the upper section of container "C" into opening 40, with membrane 44 forming an airtight seal around the outer surface of container "C". The operator can then remove the cover from container "C" and any inner material closures to access the interior of container "C". After material is removed or added as desired, the access opening into container "C" is again covered and platform 62 is lowered to removed container "C" from enclosure 12.

Certain modifications and improvements will occur to those skilled in the art upon reading the foregoing description. It should be understood that such modifications and improvements have been deleted herein for the sake of conciseness and readability but are properly within the scope of the following claims.

What is claimed is:

1. A fume hood for use in accessing the interior of a container having an upper end comprising:

a) an enclosure having a floor with an opening for insertion of the upper end of said container into said enclosure, said enclosure further including a waste discharge port attachable to a waste receptacle; and b) a base for supporting said enclosure at a level permitting insertion of one of said containers beneath the opening in said floor.

2. The fume hood of claim 1, wherein said hood further includes an inwardly projecting flexible membrane around said opening.

3. The fume hood of claim 1, wherein said hood further includes an inwardly projecting flexible membrane around said opening, and a membrane support detachable secured to said floor around said opening.

4. The fume hood of claim 1, wherein said floor has two openings for insertion of the upper ends of two containers into said enclosure.

5. The fume hood of claim 1, wherein said enclosure includes side walls with front edges and a front wall with a lower edge, the front edges of said side walls, the lower edge of said front wall, and said floor defining an access opening into said enclosure.

6. The fume hood of claim 1, wherein said front wall includes a hinged lower section.

7. The fume hood of claim 1, further including at least one plenum in communication with said enclosure.

8. The fume hood of claim 1, wherein said floor opening has a circular cross-section.

9. A fume hood for use in transferring hazardous material between first and second containers having upper ends comprising:

a) an enclosure having an interior chamber with an operator access opening into said chamber, and a floor with two openings for insertion of the upper ends of said first and second containers into said enclosure chamber, said enclosure being supported at a level permitting insertion of said containers beneath the opening in said floor; and b) an exhaust plenum in communication with said chamber.

10. The fume hood of claim 9, wherein said enclosure includes side walls with front edges and a front wall with a lower edge, the front edges of said side walls, the lower edge of said front wall, and said floor defining said operator access opening.

11. The fume hood of claim 9, wherein said hood further includes an inwardly projecting flexible membrane around said opening.

12. The fume hood of claim 9, wherein said hood further includes an inwardly projecting flexible membrane around said opening, and a membrane support detachable secured to said floor around said opening.

13. A system for accessing the interior of containers having upper ends comprising:

a) a fume hood enclosure having a floor with an opening for insertion of the upper end of said container into said enclosure;

b) a base for supporting said hood at a level permitting insertion of one of said containers beneath the opening in said floor; and c) a vertically adjustable container carrier to raise said container while said container is beneath said floor to insert the upper end of said container into said enclosure through said opening.

14. The system of claim 13, wherein said hood enclosure further includes an inwardly projecting flexible membrane around said opening, said membrane forming a seal between said container and said enclosure when said container is inserted into said opening.

15. The system of claim 13, wherein said vertically adjustable carrier is a wheeled carrier with a vertically adjustable platform to support said container.

16. The system of claim 13, further including an exhaust plenum in communication with said hood enclosure.

17. The system of claim 13, wherein said enclosure includes side walls with front edges and a front wall with a lower edge, the front edges of said side walls, the lower edge of said front wall, and said floor defining said operator access opening.

* * * * *